US006951529B1

(12) United States Patent
Ware

(10) Patent No.: US 6,951,529 B1
(45) Date of Patent: Oct. 4, 2005

(54) EXERCISE DEVICE AND METHOD

(76) Inventor: C. David Ware, 2601 Baytree Dr., Greensboro, NC (US) 27455

( * ) Notice: Subject to any disclaimer, the term of this patent is extended or adjusted under 35 U.S.C. 154(b) by 408 days.

(21) Appl. No.: 10/156,511

(22) Filed: May 28, 2002

(51) Int. Cl.[7] ..... A63B 23/16; A63B 23/14; A63B 21/06

(52) U.S. Cl. ..... 482/47; 482/45; 482/93

(58) Field of Search ..... 482/44–50, 93, 482/100, 92, 94; 601/40, 23–24; 128/845, 128/878

(56) References Cited

U.S. PATENT DOCUMENTS

| | | | | |
|---|---|---|---|---|
| 3,871,646 | A * | 3/1975 | Slack | 482/48 |
| 4,455,019 | A * | 6/1984 | Harris | 482/48 |
| 4,600,188 | A | 7/1986 | Bangerter et al. | |
| 4,811,944 | A * | 3/1989 | Hoff | 482/94 |
| 5,040,785 | A | 8/1991 | Charnitski | |
| 5,087,031 | A * | 2/1992 | Hoff | 482/46 |
| 5,147,256 | A | 9/1992 | Silagy | |
| 5,156,581 | A | 10/1992 | Chow | |
| 5,303,696 | A * | 4/1994 | Boice | 601/33 |
| 5,380,259 | A * | 1/1995 | Robertson et al. | 482/44 |
| 5,451,191 | A * | 9/1995 | Beenken | 482/47 |
| 5,573,479 | A | 11/1996 | Harris | |
| 5,613,927 | A * | 3/1997 | Rothacker | 482/123 |
| 6,036,621 | A * | 3/2000 | Hancock | 482/47 |
| 6,149,612 | A * | 11/2000 | Schnapp et al. | 601/23 |
| 6,443,874 | B1 * | 9/2002 | Bennett | 482/44 |
| 6,652,426 | B2 * | 11/2003 | Carter et al. | 482/100 |
| 6,656,092 | B1 * | 12/2003 | Fulks | 482/45 |
| 6,676,570 | B2 * | 1/2004 | Valentino | 482/45 |

* cited by examiner

*Primary Examiner*—Jerome W. Donnelly
*Assistant Examiner*—Fenn C. Mathew

(57) ABSTRACT

The invention disclosed herein provides an exercise device and method of use for strengthening the fingers and hands. The device includes a base with a handrest onto which the hand is placed in a palm-up posture with the fingers extending beneath finger pads attached to a handle joined to a rotatable shaft. Resistance to shaft rotation is encountered by the fingers and hands during exercise which allows the user to build strength and endurance. The rigid shaft includes a sprocket to which a chain having a weight load affixed permits the addition of disk shaped weights for greater resistance as the muscles of the fingers and hands become stronger.

19 Claims, 4 Drawing Sheets

EXERCISE DEVICE AND METHOD

FIELD OF THE INVENTION

The invention herein pertains to exercise equipment and particularly to strengthening equipment for the fingers and hands for mountain climbers, gymnasts and others that desire a more powerful grip.

DESCRIPTION OF THE PRIOR ART AND OBJECTIVES OF THE INVENTION

Athletes and others that climb mountains, scale walls and climb ropes require a strong grip. Many such persons exercise their fingers and hands using resistance type commercial devices such as rubber or resilient polymeric balls, tension grips and the like. However, most exercise equipment which is currently available is not resistance adjustable, thus once the user's strength reaches a certain plateau, the strength of the fingers and hands is not significantly increased by exercising for longer time periods or increasing the exercise frequency. Also, exercise balls and spring-loaded exercise equipment tends to decrease in resistance (resiliency) over time, thus allowing a user to incorrectly believe that his fingers and hands have become stronger when in fact they oftentimes have not, thereby giving the user a false sense of strength and ability.

Thus, with the problems and disadvantages of certain conventional finger and hand exercise devices, the present invention was conceived and one of its objectives is to provide an exercise device and method which can be easily used by persons desiring to strengthen their fingers and hands.

It is another objective of the present invention to provide an exercise device which allows users to increase or decrease the resistance force quickly and conveniently as needed.

It is yet another objective of the present invention to provide an exercise device which includes a handle having finger pads for individual fingers.

It is a further objective of the present invention to provide an exercise device with finger pads which can be adjusted to conform to the particular length of a user's fingers.

It is still another objective of the present invention to provide an exercise device which has a base with a rotatable shaft mounted thereon which can be loaded or unloaded with standard weights as desired by the user.

It is also another objective of the present invention to provide an exercise device for both the left and the right fingers and hands which includes a slidable arm support to stabilize the device during use.

Various other objectives and advantages of the present invention will become apparent to those skilled in the art as a more detailed description is set forth below.

SUMMARY OF THE INVENTION

The aforesaid and other objectives are realized by providing a base which is integrally formed such as by conventional molding techniques. Four legs are attached to the base for support at a convenient height from the floor or ground for use by a person either in a standing or sitting position as desired. The base includes a handrest which may be covered with a resilient material such as a standard polymeric foam for supporting the back of the user's hand while exercising. Pillow blocks positioned along the base journal a rotatable shaft which is affixed to an L-shaped handle at one end, proximate the handrest. Four rigid finger pads each having a concave surface are each separately adjustably joined to the handle by a set screw selectively engaging a rod which is slideably received by the handle. At the opposite end of the shaft beyond the base, a sprocket is affixed thereto. A chain is connected to the sprocket for suspension of a weight load. The weight load, consisting of a number of standard disks can be easily varied as needed, depending on the strength of the user.

The method of use allows a cushioned arm support which is slidably mounted underneath the base to be positioned against the arm proximate the elbow while the back of the hand is placed on the handrest. Each finger pad is individually adjusted to accommodate the particular user's finger lengths and an appropriate weight load positioned on a chain attached to the shaft sprocket acts as a means to resist the shaft rotation. The user by curling the fingers, rotates the handle and shaft. The weight load provides resistance to shaft rotation and can be adjusted by adding or subtracting standard disk weights as desired.

Once the fingers and hand on one side of the body have been sufficiently exercised, the user can exercise the other hand by positioning himself on the opposite side of the base, removing and reattaching the arm support on the opposite side beneath the base, and repositioning the chain and weight load to the opposite side of the sprocket. The handle is then turned to the far side of the handrest, away from the user and the hand inserted below and in contact with the finger pads. The exercising of that hand can commence as described above.

DETAILED DESCRIPTION OF THE PREFERRED EMBODIMENT AND OPERATION OF THE INVENTION

Figures 1, 2:
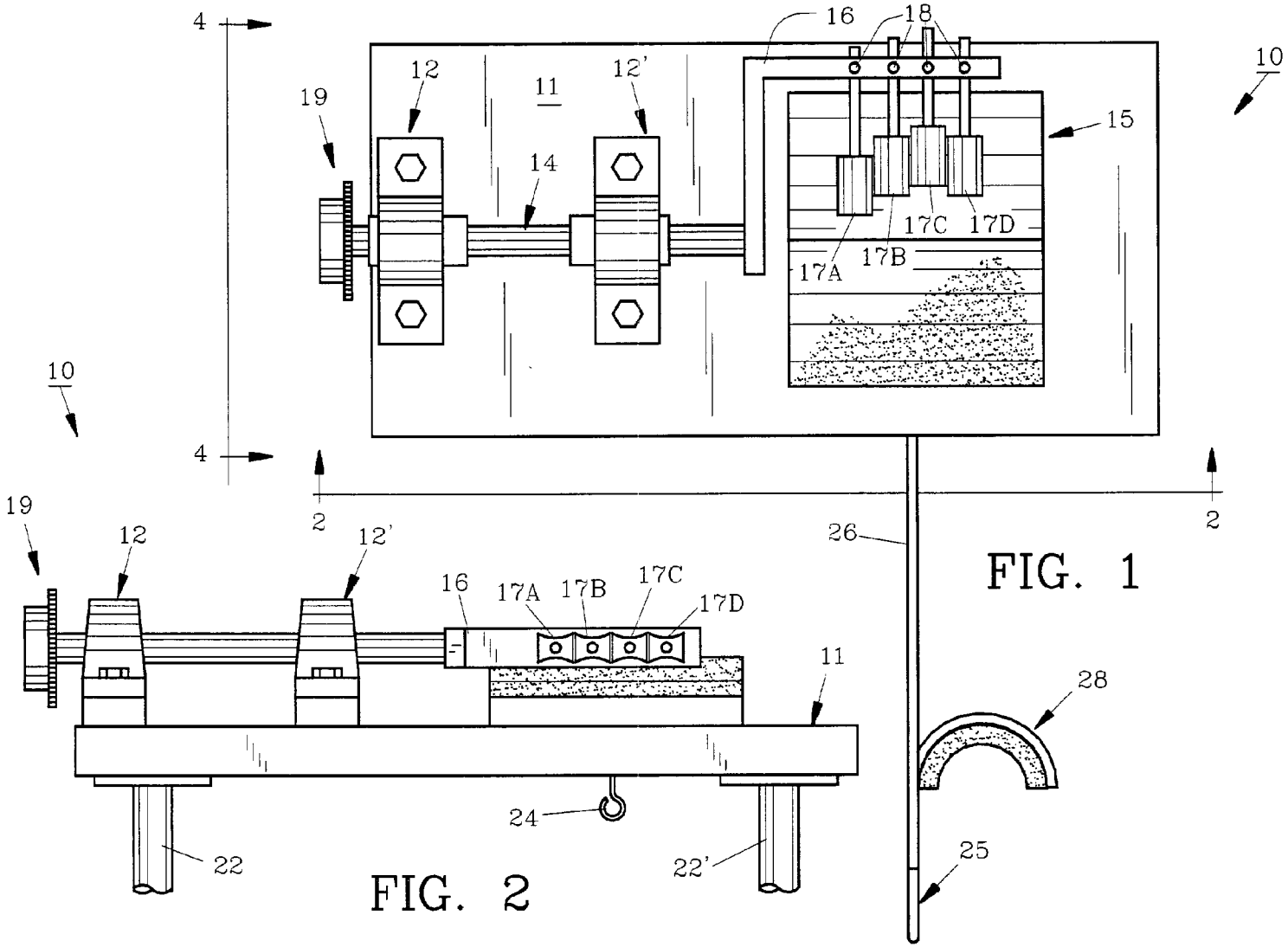
FIG. 1 shows a top view of the exercise device with the handle positioned for a user's right hand with the weight load removed.
FIG. 2 demonstrates the exercise device of FIG. 1 along lines 2—2 shown therein.
Figures 4, 5:
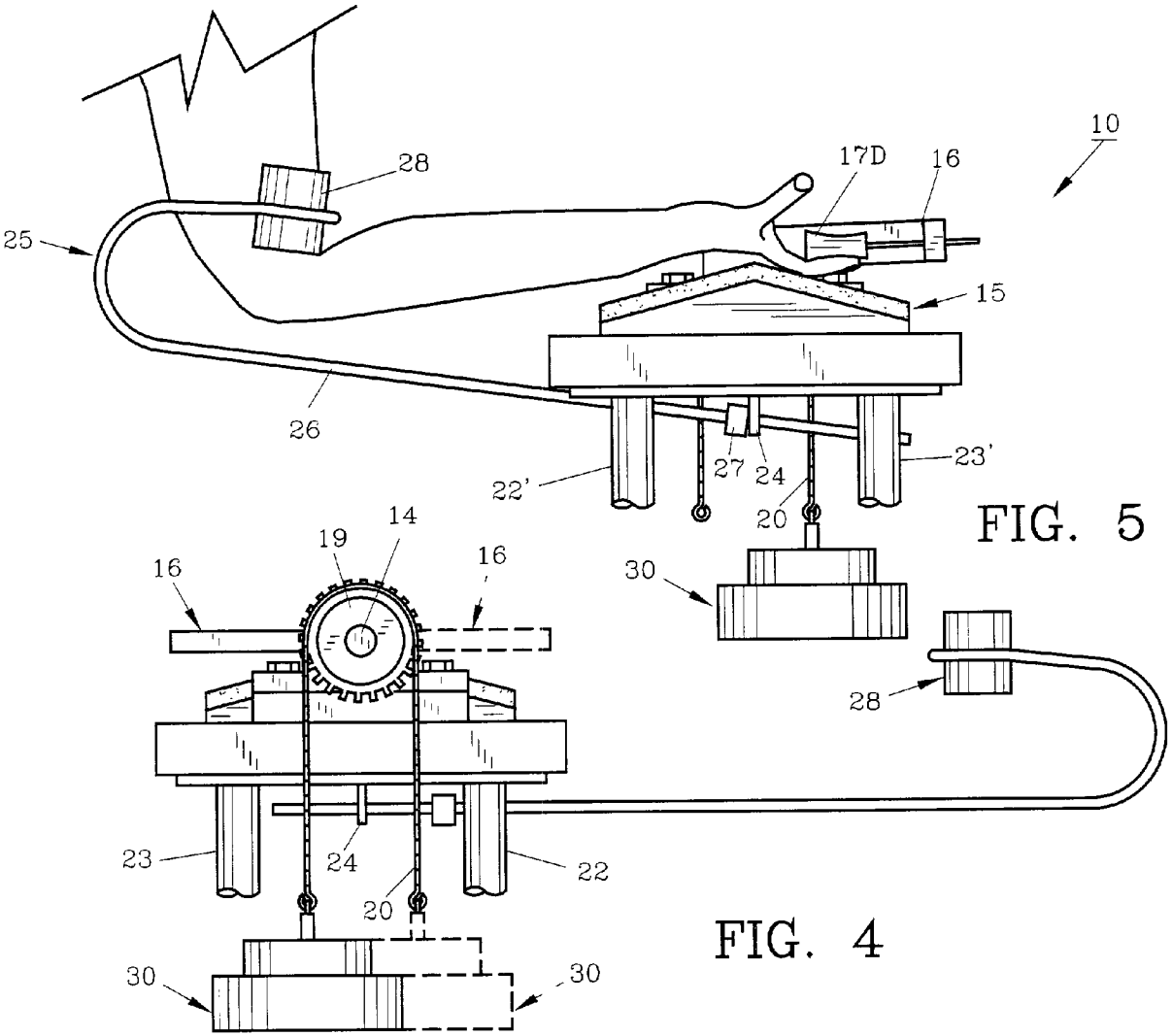
FIG. 4 pictures an end view of the exercise device seen in FIG. 1 along line 4—4 with the weight load and sprocket chain attached.
FIG. 5 depicts an opposite end view of the device as seen in FIG. 4 with the user's hand and fingers positioned as to begin exercising.
Figure 6:
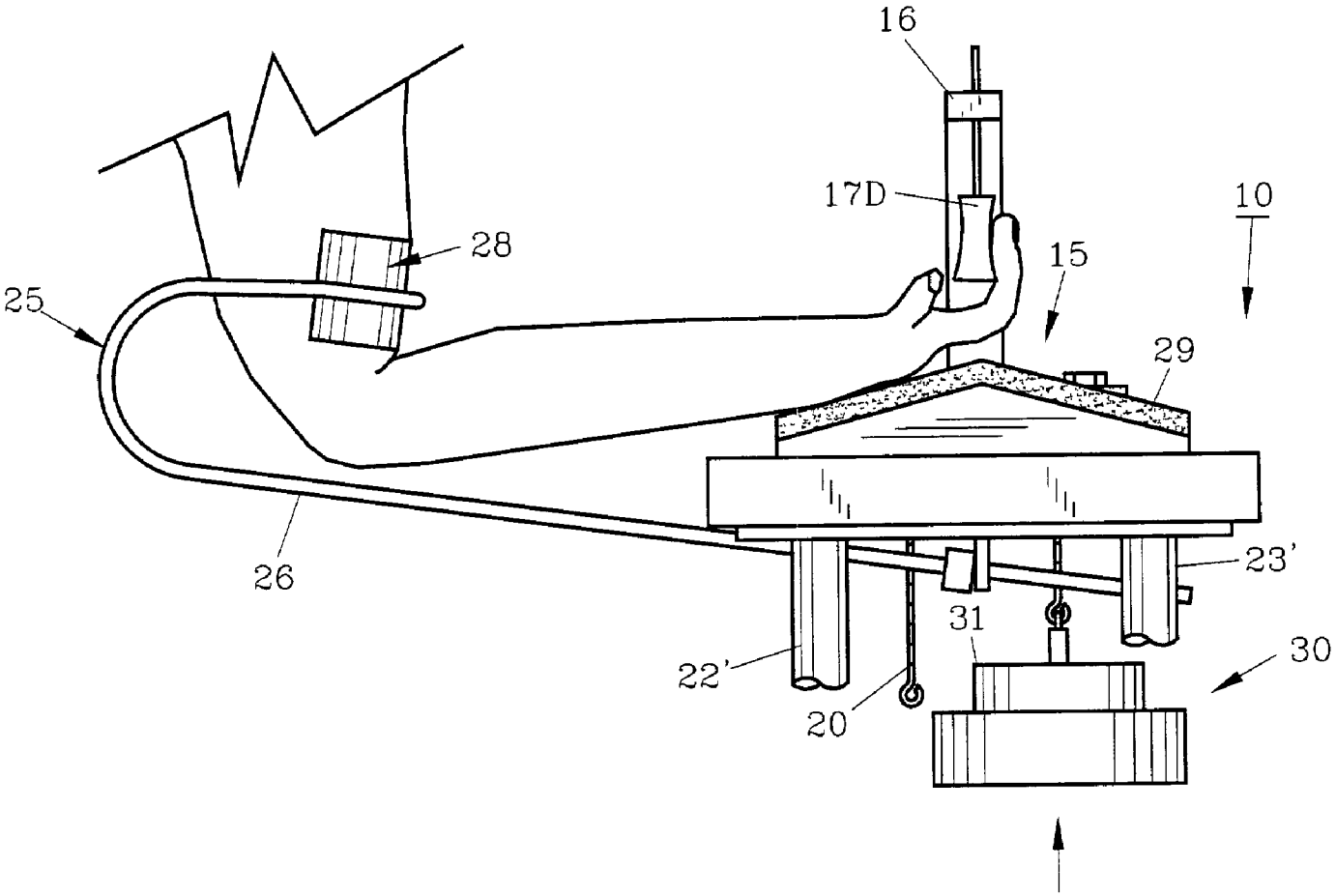
FIG. 6 features the exercise device as shown in FIG. 5 with the fingers curled to rotate the handle and raise the weight load.

For a better understanding of the invention and its operation, the preferred form of the invention as shown in FIG. 1 illustrates a top view of exercise device 10 seen without weight load 30 as depicted in FIGS. 4 and 5. Exercise device 10 includes preferably molded base 11 formed from a rigid, polymeric material such as polyurethane. Pillow blocks 12, 12' journal rigid shaft 14 and allow it to freely rotate therein. Handrest 15, which has a somewhat inverted V-shape as seen in FIG. 5 rising from base 11, is integrally molded to base 11 beneath L-shaped handle 16. Handrest 15 as depicted in FIG. 6 is covered with an attached resilient cellular foam material 29 which acts as a cushion for the back of the hand and fingers during exercising. L-shaped handle 16 is rigidly affixed to shaft 14 such as by welding or the like while finger pads 17A–17D are adjustably mounted to handle 16. Loosening and tightening setscrews 18 for individual finger pads 17A–17D allows distance adjustments to accommodate the finger lengths of a particular user. Pads 17A–17D each have a concave top and bottom surface to allow the fingers to fit and securely grip pads 17A–17D. Setscrews 18 are preferably conventional threaded hexhead setscrews although other fasteners may be used.

Figure 3:
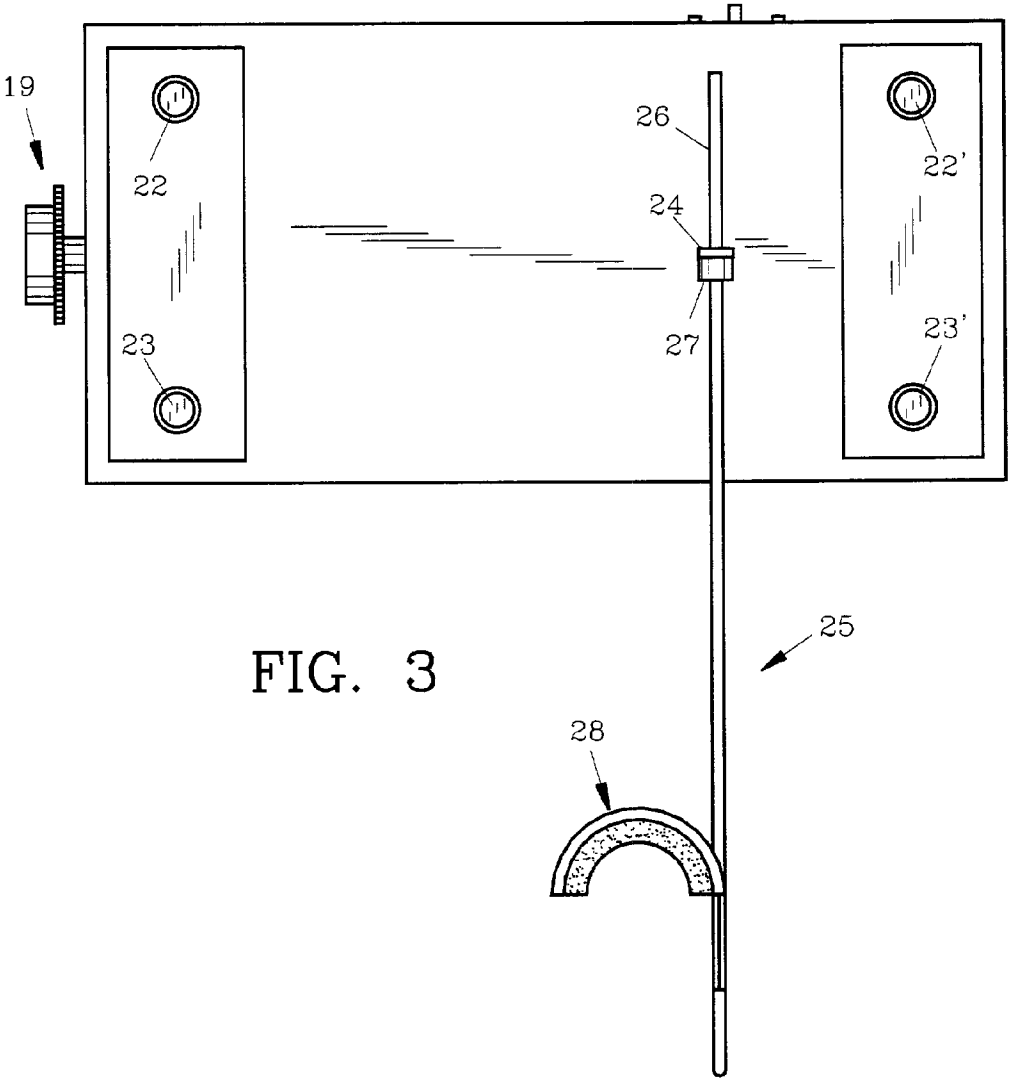
FIG. 3 illustrates a bottom view of the base as seen in FIG. 1.

At the opposite end of shaft 14 as seen in FIGS. 2 and 4 sprocket 19 is attached thereto as by welding, setscrews or otherwise. Sprocket 19 supports weight load 30 through link chain 20. In FIG. 2 a partial elevational view of preferred exercise device 10 is seen with fragmented front legs 22, 22' affixed. As would be understood, legs 22, 22', 23, 23' are preferably formed of aluminum tubing and support base 11 approximately thirty-two inches (81.28 cm) from the floor (not shown). Arm support 25 seen in FIGS. 1 and 3 is slidably mounted beneath base 11 through eyelet 24. Eyelet 24 has a threaded shank (not shown) and is joined to base 11 and is sized to allow arm support rod 26 to easily slide therethrough. Also seen in FIG. 3 is stop 27 affixed to support rod 26 which limits the movement of arm support rod 26 in eyelet 24. A setscrew (not seen) allows stop 27 to be moved and fixed therealong, depending on the length of the user's arm. Arm support 25 includes cushioned arm pad 28 which is arcuately shaped and joined to arm support rod 26 as shown in FIGS. 5 and 6.

In use, the preferred method is illustrated in FIGS. 5 and 6 which allows an athlete to either stand or sit in a comfortable position with for example, the right hand placed on handrest 15 with the fingers beneath finger pads 17A–17D. In FIG. 5 the index finger of the user's right hand is positioned beneath finger pad 17D which can be adjusted relative to handle 16 as earlier explained. Arm support 25 is then placed on the user's arm as shown in FIG. 5 and is adjusted by moving stop 27. Support 25 helps stabilize exercise device 10 during use. Once the user's arm is suitably positioned in arm support 25 with the fingers contacting finger pads 17A–17D with the thumb extended, the fingers are then curled as shown in FIG. 6. With weight load 30 adjusted for the particular user, for example thirty pounds of weight load for a ten minute session of finger curling repetitions, the fingers curl to rotate handle 16 to an upright position as shown in FIG. 6 while weight load 30 moves upwardly while resisting rotation of shaft 14 and handle 16. Additional weights 31 can be added as needed to chain 20 to supply greater resistance. By repeating the finger curls as shown in FIGS. 5 and 6, the hand and fingers become strengthened over time.

Once exercise for the right hand has been completed, handle 16 is rotated to the opposite side of shaft 14 as shown in ghost fashion in FIG. 4, the weight transferred to the opposite end of chain 20 (shown in dotted lines in FIG. 4). The user then approaches base 11 from the side opposite as shown in FIG. 6 and the left hand can then be exercised without usually readjusting finger pads 17A–17D. Again after a sufficient number of finger curls are completed, the user will have exercised both right and left hands.

The illustrations and examples provided herein are for explanatory purposes and are not intended to limit the scope of the appended claims.

What is claimed is:

1. An exercise device comprising: a base, a shaft, said shaft rotatably mounted on said base, a handle, said handle affixed to said shaft for rotating the same, said handle comprising a first and a second finger pad, said finger pads adjustably mounted on said handle for accommodating different finger lengths, and a means to resist rotation, said resistance means attached to said shaft.

2. The exercise device of claim 1 further comprising a plurality of legs, said legs attached to said base.

3. The exercise device of claim 1 further comprising a pillow block, said pillow block attached to said base for containing said shaft.

4. The exercise device of claim 1 further comprising an adjustable arm support, said arm support removably slidably affixed to said base for accommodating different arm lengths.

5. The exercise device of claim 1 further comprising a handrest, said handrest positioned on said base proximate said handle.

6. The exercise device of claim 1 wherein said resistance means comprises a load.

7. The exercise device of claim 1 further comprising a sprocket, said sprocket mounted on said shaft, said resistance means comprising a chain, a load, said load attached to said chain, said chain positioned on said sprocket whereby said load causes resistance to the rotation of said shaft.

8. The exercise device of claim 1 wherein said first finger pad comprises a concave surface for contact with a finger.

9. The exercise device of claim 1 wherein said first finger pad comprises a rod, said rod rigidly affixed to said first finger pad, and said rod slideably affixed to said handle.

10. A hand exercise device comprising: a base, a shaft, said shaft rotatably mounted on said base, a handle, said handle affixed to one end of said shaft, said handle comprising a plurality of finger pads, each of said finger pads separately adjustably mounted on said handle for accommodating a different finger length, an adjustable arm support, said arm support removably slideably mounted to said base, a means to resist shaft rotation, said resistance means affixed to the other end of said shaft, said resistance means comprising a load whereby rotating said handle encounters resistance caused by said load.

11. The hand exercise device of claim 10 further comprising a pillow block, said pillow block mounted on said base for containing said shaft.

12. The hand exercise device of claim 10 further comprising a handrest, said handrest positioned on said base proximate said handle, said handrest comprising a resilient surface.

13. The hand exercise device of claim 10 further comprising a sprocket, said sprocket mounted on said shaft, said resistance means comprising a chain, said load attached to said chain, said chain positioned on said sprocket whereby said load causes resistance to the rotation of said shaft.

14. The hand exercise device of claim 10 further comprising a pair of legs, said legs affixed to said base.

15. The hand exercise device of claim 12 wherein said handrest has an inverted V-shape whereby said handrest projects from said base.

16. The exercise device of claim 10 wherein said plurality of finger pads comprise four finger pads, each of said finger pads comprising a rod, each of said rods rigidly affixed to a different one of said finger pads, each of said rods slideably affixed to said handle, each of said rods spaced from one another, said handle further comprising set screws, each of said set screws selectively affixes a different one of said rods to said handle.

17. A method of exercising the hand and fingers utilizing a device having a rotatable shaft joined to a handle with a plurality of separately adjustable finger pads, an adjustable arm support removably attached to a base, the shaft rotationally joined to the base, and a handrest attached to the base below the handle, said method comprising the steps of:

a) adjusting the position of each finger pad to accommodate finger lengths;

b) extending the fingers beneath the finger pads; and c) lifting the finger pads by curling the fingers while rotating the shaft.

18. The method of claim 17 further comprising the step of increasing the resistance to the rotation of the shaft by adding a greater load to the shaft.

19. The method of claim 17 further comprising the steps of: adjusting the position of the arm support to accommodate arm length; positioning the arm support on the arm; and placing the hand on the handrest.

* * * * *